US012385342B2

(12) United States Patent
Patel et al.

(10) Patent No.: US 12,385,342 B2
(45) Date of Patent: Aug. 12, 2025

(54) COMPLETION LOCATOR ASSEMBLY

(71) Applicant: SCHLUMBERGER TECHNOLOGY CORPORATION, Sugar Land, TX (US)

(72) Inventors: Dinesh Patel, Humble, TX (US); Jone Sigmundsen, Stavanger (NO); Tom Krister Nilsen, Tananger (NO); Alexander Wei Lee, Houston, TX (US); Tosin Abdul-Kareem, Kuala Lumpur (MY); Evgeny Fedorchenko, Houston, TX (US); Thomas Evrard, Clamart (FR)

(73) Assignee: SCHLUMBERGER TECHNOLOGY CORPORATION, Sugar Land, TX (US)

( * ) Notice: Subject to any disclaimer, the term of this patent is extended or adjusted under 35 U.S.C. 154(b) by 0 days.

(21) Appl. No.: 18/697,764

(22) PCT Filed: Nov. 14, 2022

(86) PCT No.: PCT/US2022/049805
§ 371 (c)(1),
(2) Date: Apr. 2, 2024

(87) PCT Pub. No.: WO2023/091371
PCT Pub. Date: May 25, 2023

(65) Prior Publication Data

US 2024/0410241 A1 Dec. 12, 2024

Related U.S. Application Data

(60) Provisional application No. 63/280,402, filed on Nov. 17, 2021.

(51) Int. Cl.
*E21B 23/02* (2006.01)
*E21B 17/02* (2006.01)
(Continued)

(52) U.S. Cl.
CPC ..... *E21B 23/02* (2013.01); *E21B 17/0283* (2020.05); *E21B 17/07* (2013.01); *E21B 23/03* (2013.01)

(58) Field of Classification Search
CPC .... E21B 17/028; E21B 17/0283; E21B 23/02; E21B 17/07
See application file for complete search history.

(56) References Cited

U.S. PATENT DOCUMENTS 1,009,328 A * 11/1911 Mack ..... E21B 23/02 166/238
1,810,303 A * 6/1931 Stokes ..... E21B 23/02 92/130 C
(Continued)

FOREIGN PATENT DOCUMENTS

CN 103380258 A * 10/2013 ..... E21B 23/02
EP 2986813 A2 2/2016
(Continued)

OTHER PUBLICATIONS

Search Report and Written Opinion of International Patent Application No. PCT/US2022/049805 issued Mar. 23, 2023; 13 pages.

*Primary Examiner* — Jennifer H Gay
(74) *Attorney, Agent, or Firm* — Jeffrey D. Frantz

(57) ABSTRACT

An alignment assembly for use with a well string having a downhole tool to be positioned within a cased wellbore. The alignment assembly may include an outer assembly, an inner assembly positioned at least partially within the outer assembly, a locator, and a compensator. The locator may releasably couple the outer assembly to the inner assembly and be shaped to engage with a shoulder of the casing to align the downhole tool with a location along the casing. The compensator may be coupled to the outer assembly, positioned
(Continued)

about the inner assembly, and configured to limit relative axial movement between the outer assembly and the inner assembly.

18 Claims, 7 Drawing Sheets

(51) Int. Cl.
*E21B 17/07* (2006.01)
*E21B 23/03* (2006.01)

(56) References Cited

U.S. PATENT DOCUMENTS 2,605,843 A * 8/1952 Baker ..... E21B 23/02 166/136
2,941,599 A * 6/1960 Daffin ..... E21B 23/02 166/206
4,043,390 A * 8/1977 Glotin ..... E21B 23/02 166/217
4,844,159 A * 7/1989 Airey ..... E21B 23/02 166/385
5,566,772 A * 10/1996 Coone ..... E21B 17/07 166/242.7
6,684,952 B2 * 2/2004 Brockman ..... E21B 47/12 166/242.6
7,398,822 B2 * 7/2008 Meijer ..... E21B 17/023 166/380
8,056,619 B2 * 11/2011 Patel ..... E21B 17/028 166/242.7
9,175,523 B2 * 11/2015 Patel ..... E21B 41/0035
10,227,866 B2 * 3/2019 Godager ..... E21B 19/00
10,323,468 B2 6/2019 Patel
10,745,987 B2 * 8/2020 Werries ..... E21B 23/03
2001/0035288 A1 * 11/2001 Brockman ..... E21B 47/13 166/242.6
2002/0092653 A1 7/2002 Scott
2006/0260818 A1 * 11/2006 Meijer ..... E21B 17/023 166/380
2012/0013482 A1 * 1/2012 Patel ..... E21B 17/0283 340/854.8
2015/0047839 A1 * 2/2015 Godager ..... E21B 43/10 166/255.1
2017/0183929 A1 * 6/2017 Werries ..... E21B 23/03
2019/0249506 A1 8/2019 Goodell
2024/0410241 A1 * 12/2024 Patel ..... E21B 17/0465

FOREIGN PATENT DOCUMENTS

WO WO-2014089132 A1 * 6/2014 ..... E21B 17/07
WO WO-2016046521 A1 * 3/2016 ..... E21B 23/01

* cited by examiner

COMPLETION LOCATOR ASSEMBLY

CROSS-REFERENCE TO RELATED APPLICATIONS

This application is a national stage entry under 35 U.S.C. 371 of International Application No. PCT/US2022/049805 entitled "Completion Locator Assembly," filed Nov. 14, 2022, which claims the benefit of U.S. Provisional Application No. 63/280,402 entitled "Compensated No-Go Locator," filed Nov. 17, 2021, the disclosure of which is incorporated herein by reference in its entirety.

BACKGROUND

Many different downhole tools are typically used in the drilling of a borehole and in the production of hydrocarbons. These tools are typically located on tubing strings that are run into the borehole. In some instances, it may be necessary to align inductive couplers, a downhole tool, or other downhole components located on the tubing string within the borehole and/or a casing that lines the borehole. Additionally, it may be beneficial to allow limited axial movement of the downhole tool and/or downhole components to ensure proper spacing of the downhole tool on the tubing string.

SUMMARY

According to one or more embodiments of the present disclosure, an alignment assembly for use with a well string having a downhole tool to be positioned within a cased wellbore includes an outer assembly, an inner assembly positioned at least partially within the outer assembly, a locator, and a compensator. The locator releasably couples the outer assembly to the inner assembly and is shaped to engage with a shoulder of the casing to align the downhole tool with a location along the casing. The compensator is coupled to the outer assembly, positioned about the inner assembly, and configured to limit relative axial movement between the outer assembly and the inner assembly.

According to one or more embodiments of the present disclosure, a completion system for use within a cased wellbore includes a well string, a downhole tool coupled to the well string, and an alignment assembly coupled to the well string proximate the downhole tool. The alignment assembly includes an outer assembly, an inner assembly positioned at least partially within the outer assembly, a locator, and a compensator. The locator releasably couples the outer assembly to the inner assembly and is shaped to engage with a shoulder of the casing to align the downhole tool with a location along the casing. The compensator is coupled to the outer assembly, positioned about the inner assembly, and configured to limit relative axial movement between the outer assembly and the inner assembly.

According to one or more embodiments of the present disclosure, a method of positioning a well string a wellbore includes running a tubing string comprising an alignment assembly into the wellbore. The method also includes engaging a locator of the alignment assembly with a shoulder of a casing positioned within the wellbore to align a downhole tool with a location along the casing. The method further includes releasing an inner assembly of the alignment assembly from an outer assembly of the alignment assembly to allow relative axial movement between the outer assembly and the inner assembly. The method also includes limiting relative axial movement between the outer assembly and the inner assembly via a compensator.

However, many modifications are possible without materially departing from the teachings of this disclosure. Accordingly, such modifications are intended to be included within the scope of this disclosure as defined in the claims.

BRIEF DESCRIPTION OF THE DRAWINGS

Certain embodiments of the disclosure will hereafter be described with reference to the accompanying drawings, wherein like reference numerals denote like elements. It should be understood, however, that the accompanying figures illustrate the various implementations described herein and are not meant to limit the scope of various technologies described herein, and.

DETAILED DESCRIPTION

In the following description, numerous details are set forth to provide an understanding of some embodiments of the present disclosure. However, it will be understood by those of ordinary skill in the art that the system and/or methodology may be practiced without these details and that numerous variations or modifications from the described embodiments may be possible.

In the specification and appended claims, the terms "connect," "connection," "connected," "in connection with," and "connecting," are used to mean "in direct connection with," in connection with via one or more elements." The terms "couple," "coupled," "coupled with," "coupled together," and "coupling" are used to mean "directly coupled together," or "coupled together via one or more elements." The term "set" is used to mean setting "one element" or "more than one element." As used herein, the terms "up" and "down," "upper" and "lower," "upwardly" and "downwardly," "upstream" and "downstream," "uphole" and "downhole," "above" and "below," "top" and "bottom," and other like terms indicating relative positions above or below a given point or element are used in this description to more clearly describe some embodiments of the disclosure. Commonly, these terms relate to a reference point at the surface from which drilling operations are initiated as being the top point and the total depth being the lowest point, wherein the well (e.g., wellbore, borehole) is vertical, horizontal, or slanted relative to the surface.

Embodiments described herein use induction principles to enable power and/or information data to be conveyed between the male and female inductive couplers. The male inductive coupler and the female inductive coupler each may comprise at least one coil, a magnetic core, and a metal sleeve enclosing the at least one coil and magnetic core. The coil and magnetic core of the male inductive coupler are radially aligned with the coil and magnetic core of the female inductive coupler to facilitate inductive transfer of power and/or data signals.

A magnetic field is created by running electrical current through the coil or coils of one of the inductive couplers. The electrical current induces a current flow in the opposed coil or coils of the other inductive coupler. This allows power and/or data signals to be transferred across the casing, i.e. across the casing wall.

Figure 1:
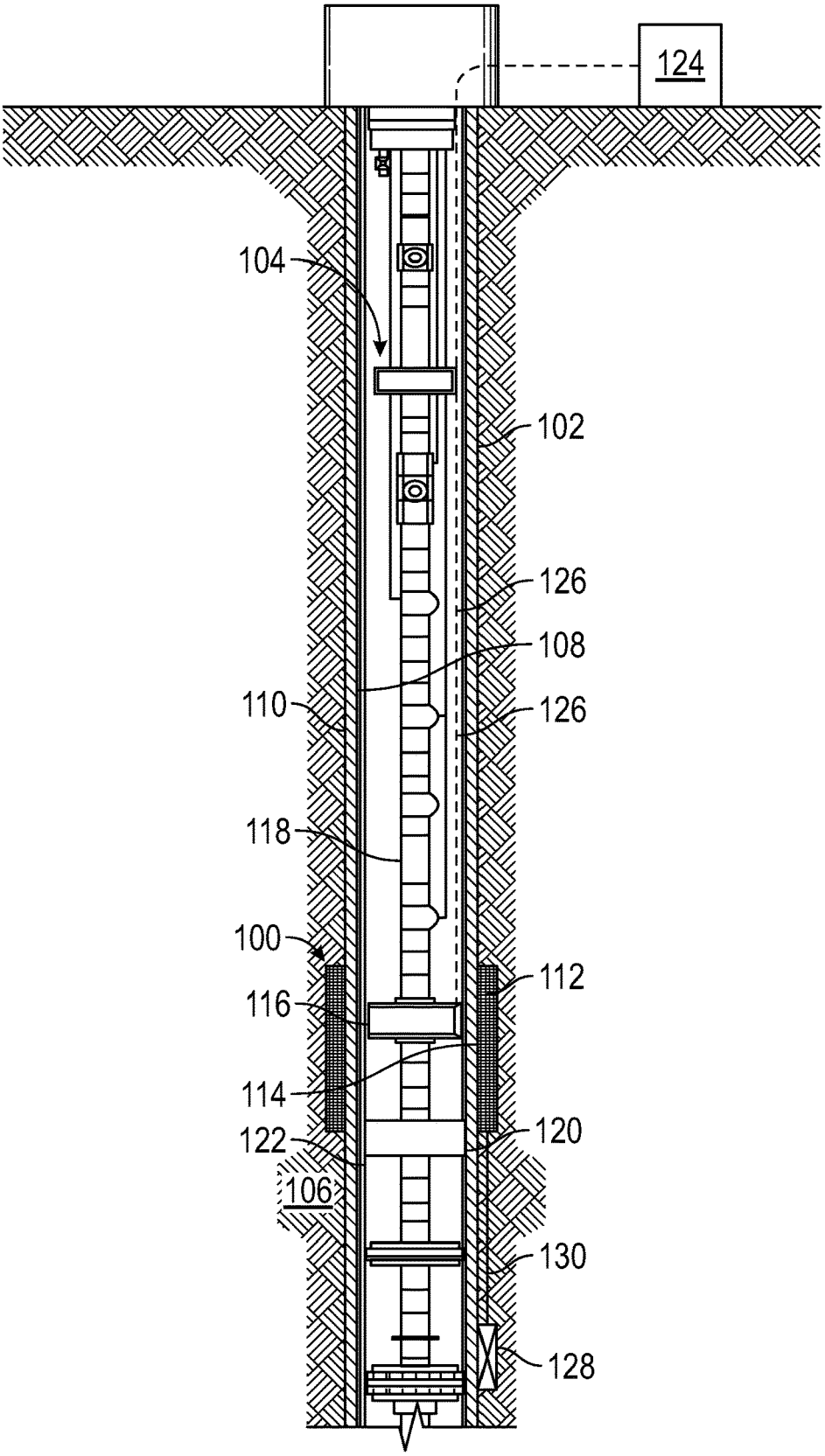
FIG. 1 is a schematic illustration of an example of an inductive coupler located along a well casing deployed in a wellbore, according to one or more embodiments of the present disclosure.

Referring generally to FIG. 1, an example of an inductive coupler system 100 is illustrated as disposed along a casing 102. By way of example, the casing 102 may be disposed along a wellbore 104 drilled into a subterranean formation 106. In some well applications, the well casing 102 is formed of non-magnetic, low conductivity metal. The casing 102 has an interior surface 108 and an exterior surface 110. An outer or female inductive coupler 112 of inductive coupler system 100 is illustrated as positioned at a desired exterior location along the exterior surface 110 of casing 102. The female inductive coupler 112 may be constructed with a circular interior 114 sized to encircle the casing 102. Once positioned in the desired location, the female inductive coupler 112 can be secured by suitable fasteners and/or devices.

The inductive coupler system 100 also comprises a male inductive coupler 116 positioned along a tubing string 118 run within the casing 102. As shown in FIG. 1, the tubing string 118 includes an alignment assembly 120, as described in more detail below, that contacts a shoulder 122 or similar feature within the casing 102 to prevent further downhole movement of the tubing string, thus aligning the male and female inductive couplers 116, 112. In other embodiments, the male inductive coupler 116 may be mounted on a well tool or well completion that carries the coupler 116 to the desired interior location.

As further illustrated in FIG. 1, the inductive coupler system 100 may be connected to a control system 124, such as a surface control system. The control system 124 may be used to send and/or receive power and data signals via a suitable communication line 126, such as a wired or wireless communication line. By way of example, the control system 124 may be designed to send power and data signals downhole while receiving data signals from an electrical device 128 (or devices 128) located downhole. In the example illustrated, the electrical device 128 is connected with female inductive coupler 112 and positioned externally of casing 102. The electrical device 128 may be connected directly with female inductive coupler 112 or connected via a suitable cable 130, e.g. a permanent downhole cable. The electrical device 128 also may comprise a variety of sensors or other devices used to accumulate data on formation parameters or other well related parameters. In some applications, the electrical device 128 may comprise one or more pressure sensors to monitor pressure outside of casing 102.

Figure 2:
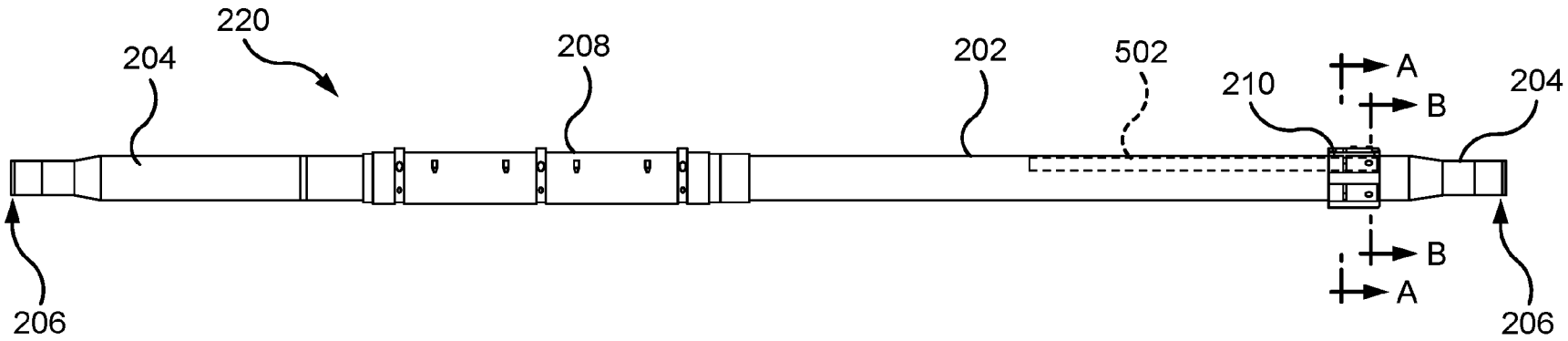
FIG. 2 is an alignment assembly for a tubing string, according to one or more embodiments of the present disclosure.

Turning now to FIG. 2, FIG. 2 is an alignment assembly 220 for a tubing string, according to one or more embodiments of the present disclosure. The alignment assembly 220 includes an outer assembly 202, an inner assembly 204, the end portions 206 of which are coupled to the tubing string, and a compensator assembly 208. The alignment assembly 220 also includes a locator 210 that couples the inner assembly 204 to the outer assembly 202.

As described above, a downhole tool or a downhole component, such as an inductive coupler, is coupled to the alignment assembly 220, which is then run into a wellbore. The alignment assembly 220 ensures that the downhole tool or downhole component proximate the alignment assembly is properly aligned with a desired location along a casing cemented within the wellbore or aligned with a counterpart component coupled to the casing. Additionally, the compensator assembly 208 allows for limited axial movement of the inner assembly 204 relative to the outer assembly 202 to maintain axial alignment of the downhole tool or downhole component with the component on the casing.

Figure 3:
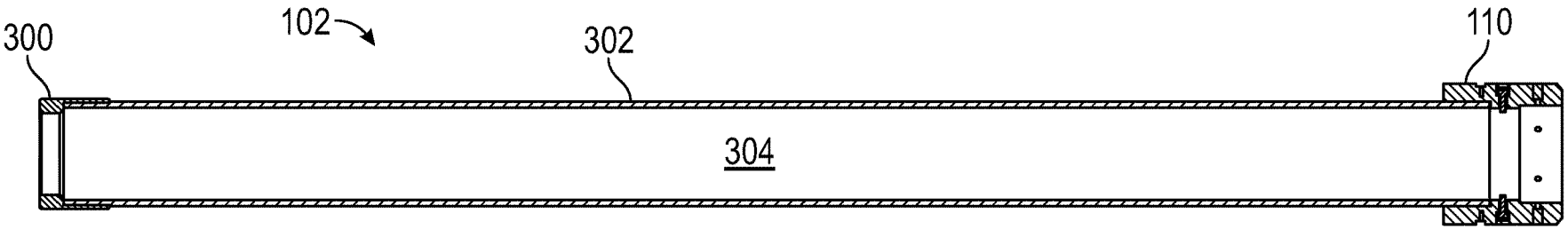
FIG. 3 is the outer assembly of the alignment assembly of FIG. 2.

Turning now to FIG. 3, FIG. 3 is the outer assembly 202 of FIG. 2. The outer assembly includes a top nut 300 and an outer pup 302. The top nut 300 is coupled to a first end of the outer pup 302 and the locator 210 is coupled to the opposite end of the downhole pup. Additionally, the length of the outer pup 302 can vary to allow different sizes of downhole tools or downhole components to be coupled to the exterior of the outer pup 302. The bore 304 of the outer pup 302 is sized to allow the inner assembly to pass through the outer pup 302 to allow for relative axial movement between the outer assembly 202 and the inner assembly 204.

Figure 4:
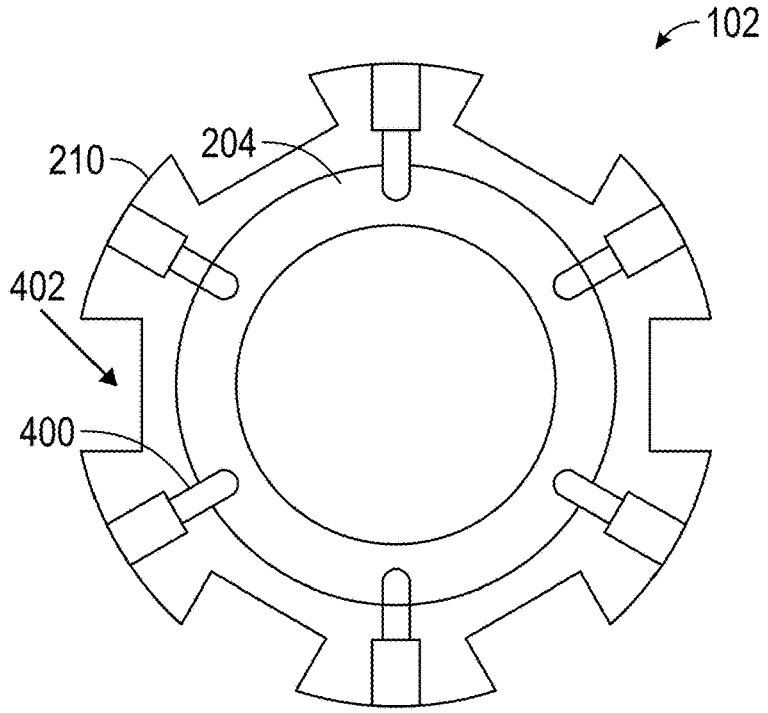
FIG. 4 is a cross-sectional view of the locator of the alignment assembly of FIG. 2 along line AA.
Figure 5:
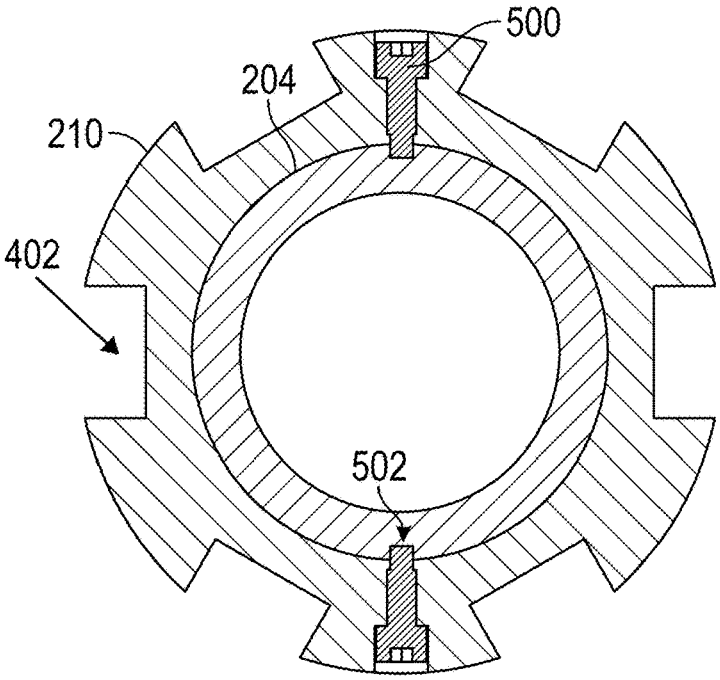
FIG. 5 is a cross-sectional view of the locator of the alignment assembly of FIG. 2 along line BB.

Turning now to FIGS. 4 and 5, FIGS. 4 and 5 are cross-sectional views of the locator 210 of FIG. 2, along lines AA and BB, respectively. As shown in FIG. 4, the locator 210 is coupled to the inner assembly 204 via shear pins 400. However, the invention is not thereby limited. Other embodiments may include shear rings or releasable retaining devices in addition to or in place of the shear pins 400. The locator 210 may also include grooves or channels formed into the outer surface of the locator 210 to allow control lines to pass around the locator 210. Although six channels 402 are shown in FIGS. 4 and 5, the locator may include more or fewer channels 402 without departing from the scope of this disclosure.

In operation, as the alignment assembly 220 is run downhole, the locator 210 contacts a shoulder, such as the shoulder 122 described above with reference to FIG. 1, coupled to the wellbore or casing, or formed from the casing. Once the locator 210 contacts the shoulder, additional force is applied to tubing string to shear the shear pins 400 coupling the inner assembly 204 to the locator 210. Once the shear pins 400 are sheared, the inner assembly 204 can move axially relative to the outer assembly 202 and the locator 210. Additionally, the locator 210 may include guide pins 500 that extend through the locator 210 and into respective channels 502 (FIGS. 2, 5, and 8) formed in the inner assembly 204. The guide pins 500 and the channels 502 reduce or prevent relative radial movement between the locator 210 and the inner assembly 204.

Figure 6:
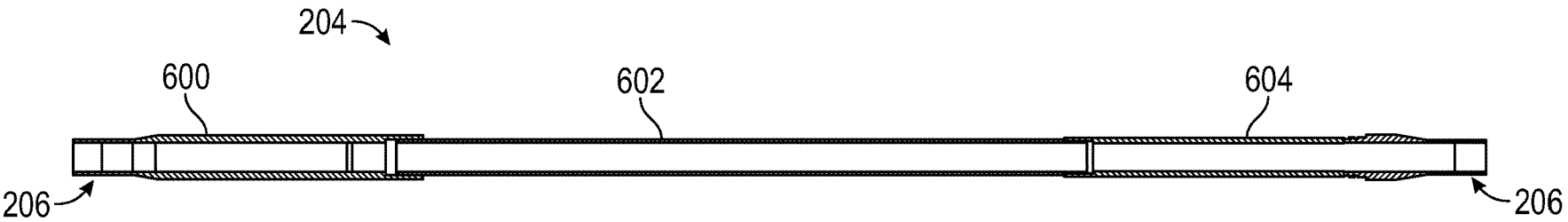
FIG. 6 is the inner assembly of the alignment assembly of FIG. 2.

Turning now to FIG. 6, FIG. 6 is the inner assembly 204 of FIG. 2. The inner assembly 204 includes a top sub 600, an inner pup 602, and a lower sub 604. As discussed above, the inner assembly 204 is coupled to the tubing string at both end portions. Additionally, the inner pup 602 and a portion of the lower sub 604 are disposed within the outer assembly 202 and the lower sub is coupled to the locator 210, as discussed above.

Figure 7:
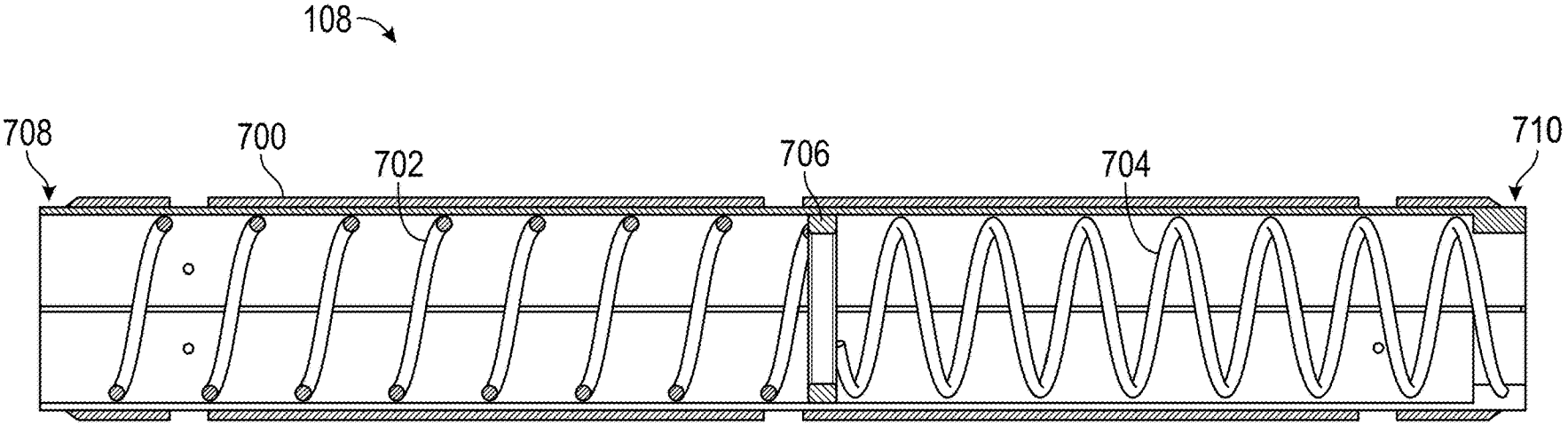
FIG. 7 is the compensator assembly of the alignment assembly of FIG. 2.

Turning now to FIG. 7, FIG. 7 is the compensator assembly 208 of FIG. 1. The compensator assembly 208 includes an outer housing 700 surrounding two springs 702, 704 that are separated by a spacer 706. The compensator assembly 208 is installed around the inner assembly 204 and is retained in position via engagement between the top sub 600 of the inner assembly 204 and the spring 702 or a spacer above the spring 702 on the uphole end portion 708 of the compensator assembly 208 and engagement between the top nut 300 of the outer assembly 202 and the outer housing 700 on the downhole end portion 710 of the compensator assembly 208.

Figure 8:
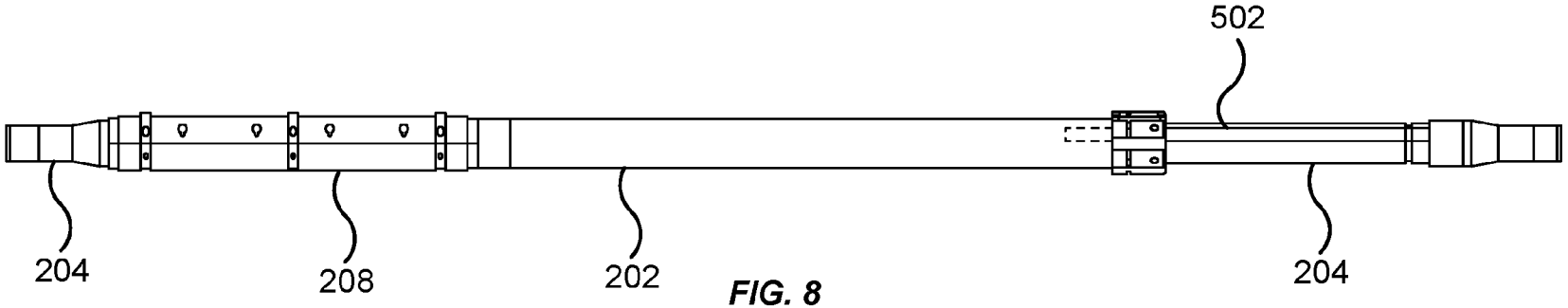
FIG. 8 is the alignment assembly of FIG. 2 in a compressed position.

In operation, the relative axial movement of the inner assembly 204 and the outer assembly 202 compresses the springs 702, 704 within the compensator assembly 208, shifting the outer housing 700 compensator assembly 208 relative to the inner assembly 204, as shown in FIG. 8. The compensator assembly 208 limits the relative axial movement of the outer assembly 202 and the inner assembly 204, while the springs 702, 704 within the compensator assembly 208 act as a damping mechanism.

As used herein, a range that includes the term between is intended to include the upper and lower limits of the range; e.g., between 50 and 150 includes both 50 and 150. Additionally, the term "approximately" includes all values within 5% of the target value; e.g., approximately 100 includes all values from 95 to 105, including 95 and 105. Further, approximately between includes all values within 5% of the target value for both the upper and lower limits; e.g., approximately between 50 and 150 includes all values from 130.5 to 157.5, including 130.5 and 157.5.

Although a few embodiments of the disclosure have been described in detail above, those of ordinary skill in the art will readily appreciate that many modifications are possible without materially departing from the teachings of this disclosure. Accordingly, such modifications are intended to be included within the scope of this disclosure as defined in the claims.

What is claimed is:

1. An alignment assembly for use with a well string having a downhole tool to be positioned within a cased wellbore, the alignment assembly comprising:

an outer assembly;

an inner assembly positioned at least partially within the outer assembly, and including a plurality of channels;

a locator releasably coupling the outer assembly to the inner assembly and shaped to engage with a shoulder of the casing to align the downhole tool with a location along the casing, the locator including guide pins engaged with corresponding channels of the plurality of channels and configured to permit relative axial movement between the outer assembly and the inner assembly, and limit relative rotational movement between the locator and the inner assembly; and a compensator assembly coupled to the outer assembly and positioned about the inner assembly configured to limit the relative axial movement between the outer assembly and the inner assembly.

2. The alignment assembly of claim 1, wherein the compensator assembly further comprises a damping mechanism.

3. The alignment assembly of claim 2, wherein the damping mechanism comprises a plurality of springs disposed within a housing of the compensator assembly.

4. The alignment assembly of claim 3, wherein a first spring of the plurality of springs is separated from a second spring of the plurality of springs via a spacer.

5. The alignment assembly of claim 1, wherein the locator is configured to releasably couple the outer assembly to the inner assembly via shear pins extending through the locator and into channels formed in the inner assembly.

6. The alignment assembly of claim 1, wherein the locator comprises additional channels formed in an outer surface of the locator.

7. A completion system for use within a cased wellbore, the completion system comprising:

a well string;

a downhole tool coupled to the well string; and an alignment assembly coupled to the well string and proximate the downhole tool, the alignment assembly comprising:

an outer assembly;

an inner assembly positioned at least partially within the outer assembly, and including a plurality of channels;

a locator releasably coupling the outer assembly to the inner assembly and shaped to engage with a shoulder of the casing to align the downhole tool with a location along the casing, the locator including guide pins engaged with corresponding channels of the plurality of channels and configured to permit relative axial movement between the outer assembly and the inner assembly, and limit relative rotational movement between the locator and the inner assembly; and a compensator assembly positioned about the inner assembly configured to limit the relative axial movement between the outer assembly and the inner assembly.

8. The completion system of claim 7, wherein the compensator assembly further comprises a damping mechanism.

9. The completion system of claim 8, wherein the damping mechanism comprises a plurality of springs disposed within a housing of the compensator assembly.

10. The completion system of claim 9, wherein a first spring of the plurality of springs is separated from a second spring of the plurality of springs via a spacer.

11. The completion system of claim 7, wherein the locator is configured to releasably couple the outer assembly to the inner assembly via shear pins extending through the locator and into channels formed in the inner assembly.

12. The completion system of claim 7, wherein the locator comprises additional channels formed in an outer surface of the locator.

13. The completion system of claim 7, wherein the downhole tool comprises a male inductive coupler.

14. The completion system of claim 13, further comprising a female inductive coupler couplable to an exterior of the casing.

15. The completion system of claim 14, further comprising an electrical device in electronic communication with the female inductive coupler.

16. The completion system of claim 14, further comprising a control system in electronic communication with the downhole tool.

17. A method of positioning a well string within a wellbore, the method comprising:

running a tubing string comprising an alignment assembly into the wellbore;

engaging a locator of the alignment assembly with a shoulder of a casing positioned within the wellbore to align a downhole tool with a location along the casing, the locator including guide pins engaged with corresponding channels in an inner assembly configured to permit relative axial movement between an outer assembly and the inner assembly, and limit relative rotational movement between the locator and the inner assembly;

releasing the inner assembly of the alignment assembly from the outer assembly of the alignment assembly to allow the relative axial movement between the outer assembly and the inner assembly; and limiting the relative axial movement between the outer assembly and the inner assembly via a compensator.

18. The method of claim 17, wherein engaging the locator with the shoulder of the casing comprises aligning a male inductive coupler of the downhole tool with a female inductive coupler positioned at the location along the casing.

* * * * *